US009920613B2

(12) United States Patent
Lee et al.

(10) Patent No.: US 9,920,613 B2
(45) Date of Patent: Mar. 20, 2018

(54) METHOD AND SYSTEM FOR AN AUTOMATIC MILLING OPERATION

(71) Applicant: Schlumberger Technology Corporation, Sugar Land, TX (US)

(72) Inventors: Grant Lee, Houston, TX (US); Michael Jensen, Richmond, TX (US); Neil Herbst, Houston, TX (US); Sarah Blake, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 891 days.

(21) Appl. No.: 14/355,794

(22) PCT Filed: Nov. 2, 2012

(86) PCT No.: PCT/US2012/063174

§ 371 (c)(1),
(2) Date: May 1, 2014

(87) PCT Pub. No.: WO2013/067263

PCT Pub. Date: May 10, 2013

(65) Prior Publication Data

US 2014/0305653 A1 Oct. 16, 2014

Related U.S. Application Data

(60) Provisional application No. 61/555,696, filed on Nov. 4, 2011.

(51) Int. Cl.
*E21B 44/00* (2006.01)
*E21B 29/00* (2006.01)
(Continued)

(52) U.S. Cl.
CPC ..... *E21B 44/005* (2013.01); *E21B 4/18* (2013.01); *E21B 29/002* (2013.01); *E21B 44/02* (2013.01); *E21B 2023/008* (2013.01)

(58) Field of Classification Search
CPC . E21B 7/04; E21B 4/18; E21B 44/005; E21B 7/26; E21B 29/002; E21B 44/02; E21B 2023/008; E21B 44/04
See application file for complete search history.

(56) References Cited

U.S. PATENT DOCUMENTS 5,060,737 A 10/1991 Mohn
6,273,189 B1 * 8/2001 Gissler ..... E21B 4/04 166/241.1
(Continued)

FOREIGN PATENT DOCUMENTS

CN 101868595 A 10/2010
EP 1640556 A1 3/2006
(Continued)

OTHER PUBLICATIONS

International Search Report for International Application No. PCT/US2012/063174 dated Mar. 12, 2013.
(Continued)

*Primary Examiner* — Michael R Wills, III
(74) *Attorney, Agent, or Firm* — Trevor G. Grove

(57) ABSTRACT

A method (50) and an assembly (10) for milling an obstruction disposed within a wellbore (W) includes a milling module (12) having a motor (22) rotating a milling bit (14), a first electronics cartridge (26) for controlling the motor based upon a motor torque value, a tractor module (16, 18) for engaging with the wellbore and providing a push force against the wellbore to urge the milling assembly in a direction of the milling bit, and a second electronics cartridge (28) for controlling a push force value of tractor module. The method involves rotating the milling bit (54)
(Continued)

and engaging the tractor module with the wellbore (56), and adjusting, iteratively, the operation (58) based on a calculated torque value and a calculated push force value to maintain the calculated values at around a target torque value and below a push force limit value (66, 70).

20 Claims, 3 Drawing Sheets

(51) Int. Cl.

| | |
|---|---|
| ***E21B 44/02*** | (2006.01) |
| ***E21B 4/18*** | (2006.01) |
| *E21B 23/00* | (2006.01) |

(56) References Cited

U.S. PATENT DOCUMENTS

| | | | | |
|---|---|---|---|---|
| 7,185,714 | B2 * | 3/2007 | Doering | E21B 4/18 175/24 |
| 7,422,076 | B2 | 9/2008 | Koederitz et al. | |
| 7,610,970 | B2 * | 11/2009 | Sihler | E21B 44/005 175/24 |
| 2004/0195004 | A1 | 10/2004 | Power et al. | |
| 2005/0133259 | A1 | 6/2005 | Koederitz | |
| 2006/0151212 | A1 | 7/2006 | Doering et al. | |
| 2007/0251687 | A1 | 11/2007 | Martinez et al. | |
| 2008/0156531 | A1 | 7/2008 | Boone et al. | |
| 2012/0261190 | A1 * | 10/2012 | Krueger, IV | E21B 44/005 175/24 |

FOREIGN PATENT DOCUMENTS

| | | | |
|---|---|---|---|
| GB | 2454907 | A | 5/2009 |
| RU | 2424430 | C2 | 7/2011 |
| WO | WO2005113930 | A1 | 12/2005 |
| WO | 2007017046 | A1 | 2/2007 |
| WO | 2009022114 | A1 | 2/2009 |

OTHER PUBLICATIONS

Juel et al. "Wireline Tractor Milling Operations From a Riserless Light-Well Intervention Vessel at the High-Temperature Asgard Field," 121481-MS, SPE/ICoTA Coiled Tubing & Well Intervention Conference and Exhibition, Society of Petroleum Engineers, 2009, pp. 1-5.

Krüger et al. "Milling of Isolation Valve with Wireline Conveyed Technology," SPE/IADC 92024-MS, SPE/IADC Drilling Conference, Society of Petroleum Engineers, 2005, pp. 1-4.

Decision on Grant issued in related RU application 2014122549 dated Sep. 8, 2016, 16 pages.

European Search Report issued in related EP application 12845131.7 dated Jun. 29, 2016, 5 pages.

Article 94(3) EPC issued in related EP application 12845131.7 on Jul. 22, 2016, 7 pages.

International Preliminary Report on patentabiltiy issued in the related PCT application PCT/US2012/063174, dated Mar. 12, 2013 (4 pages).

European Office action issued in the related EP Application 12845131.7, dated Mar. 7, 2017, 4 pages.

Office action issued in the related MX application MX/a/2014/005320, dated Sep. 13, 2007, 6 pages.

Office action issued in the related CN Application 201280065992.5, dated Jun. 16, 2015 (13 pages).

* cited by examiner

METHOD AND SYSTEM FOR AN AUTOMATIC MILLING OPERATION

BACKGROUND

The present disclosure is related in general to wellsite equipment such as oilfield surface equipment, downhole assemblies, and the like.

Milling systems are utilized to mill scale deposits that have formed on interior portions of a wellbore or other wellbore obstructions. A benefit of using a wireline milling system is the ability to provide precision milling without mobilizing coiled tubing or heavy surface equipment for circulating and handling fluids. Without controlling the torque on bit, however, the rotary movement may cause to damage weak points in the tool-string or wellbore completion when producing too much torque on bit. Also, when the push force is not strong enough, the user may not realize that the rotary module is not cutting the scale, spinning freely. It is desirable to be able to conduct a milling operation automatically because even with real-time measurement of torque on bit, it may be difficult to operate the tool if the user has to change tractor push force manually. The operation may be time-consuming and cumbersome.

It is desirable to provide a convenient and intuitive tool control that provides tool protection at the same time. It remains desirable to provide improvements in oilfield surface equipment and/or downhole assemblies.

SUMMARY

The method according to the disclosure involves an algorithm to perform an efficient and intuitive milling operation in a wellbore, such as a cased-hole environment. The automatic milling algorithm achieves controlled material removal operation while minimizing unnecessary human interactions.

The automatic milling algorithm controls a milling assembly that utilizes at least one wheeled tractor module to push the bit of a milling module against the scale to generate weight on the bit. The automatic milling algorithm monitors a torque measurement from the motor in the milling module as a feedback to generate an appropriate push force from the tractor module. The algorithm tries to achieve a target torque value on the bit set by the user by automatically adjusting the tractor push force within predetermined limits also set by the user. The algorithm achieves efficient scale removal by minimizing stalling of the bit due to high reactive torque and allows the user to take appropriate actions (or make automatic adjustments) in cases of bit stall.

The milling assembly includes a first electronics cartridge that drives the motor rotating the bit and senses the motor torque to generate the real-time feedback signal. The milling assembly may include a second electronics cartridge that drives the tractor module to control the push force in response to the torque feedback signal. The milling assembly is connected to a suitable well access line such as a wireline cable, a length of coiled tubing or the like. The well access line extends from a surface of the wellbore and is in communication with surface equipment, control equipment, and the like. The automatic milling algorithm can be implemented as firmware and/or software located in one or more of the first electronics cartridge, the second electronics cartridge and the control equipment on the surface.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Figure 1:
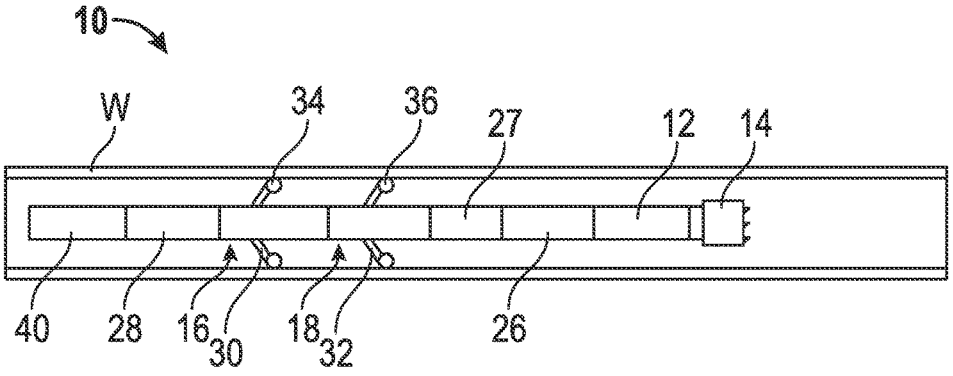
FIG. 1 is a cross-sectional view through a wellbore showing a milling or bottom hole assembly according to the disclosure.
Figure 2:
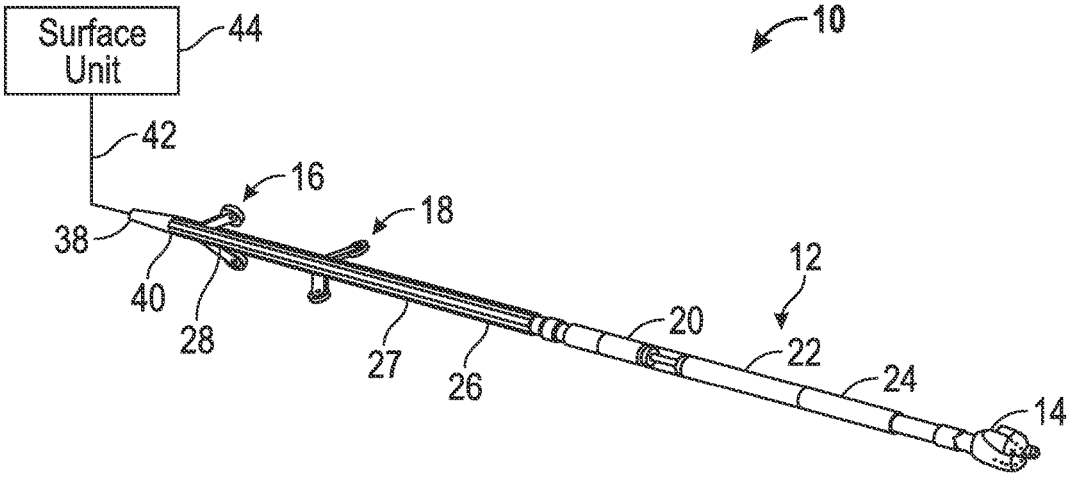
FIG. 2 is a perspective view of the milling or bottom hole assembly shown in FIG. 1.

Referring now to FIGS. 1 and 2, there is disclosed a milling assembly or bottom hole assembly, indicated generally at 10. The assembly 10 comprises a rotary or milling module 12 for driving a mill bit 14 and a pair of tractor modules 16 and 18 for advancing the assembly 10 in a wellbore W and for providing force to the mill bit 14 during operation of the assembly 10, discussed in more detail below.

The rotary or milling module 12 comprises a compensator 20, a motor 22 and a gearbox 24, which is coupled to or in communication with the mill bit 14. An electronics cartridge 26 provides power and telemetry to and acquires or receives telemetry from the various components 14, 20, 22, 24 of the rotary module 12, and controls the operation of the rotary module. The motor 22 may comprise a three-phase permanent magnetic synchronous motor which is driven by the electronics cartridge 26. The cartridge 26 may implement field-oriented control in its firmware.

An electronics cartridge 28 provides power and telemetry to and acquires or receives telemetry from the tractor modules 16 and 18. The tractor modules 16 and 18 may each comprise pivotally extending arms 30 and 32 having wheels 34 and 36 on free ends thereof for rotating and engaging with the walls of the wellbore, such as an open hole or the cased wellbore W shown in FIG. 1, as will be appreciated by those skilled in the art. The tractor modules 16 and 18 may comprise a motor (not shown) such as an electric motor, a hydraulic motor or the like, for extending and retracting the arms 30 and 32 and for rotating and driving the wheels 34 and 36. The assembly 10 may also comprise a compensator module 27 as a hydraulic oil reservoir used for opening the tractor arms 30 and 32. When the wheels 34 and 36 are engaged with the wellbore, the tractor modules 16 and 18 provide a push force for the assembly 10 in the direction of the bit 14. The electronic cartridges 26 and 28 are in communication with one another, which aids in the operation of the assembly 10, discussed in more detail below. While the embodiments illustrated show a plurality of electronic cartridges 26 and 28, those skilled in the art will appreciate that the electronics of the cartridges 26 and 28 may be combined into a single cartridge with the same functionality of each of the cartridges 26 and 28. The assembly 10 may further comprise an additional push module or modules for providing a push force for the assembly 10 in the direction of the bit 14, such as a linear actuator and anchor assembly for engaging with the wellbore in addition to or in lieu of the tractor modules 16 and 18 during operation of the assembly 10 discussed in more detail below.

The assembly 10 further comprises a logging head 38 on an end thereof opposite the end of the mill bit 14 and a telemetry cartridge 40 connected to the logging head 38. The logging head 38 may be attached to a suitable well access line 42 such as a wireline cable, a length of coiled tubing or the like. The well access line 42 extends from a surface of the wellbore and is in communication with surface equipment, control equipment, and the like identified as a surface unit 44 for communication of power, telemetry and control signals. A user can direct operation of the assembly 10 from the surface unit 44 including setting a target torque value, setting a push force limit value, starting rotation of the bit 14 and starting an automatic milling algorithm.

In operation, the assembly 10 is deployed into the wellbore on the well access line and maneuvered into a desired location within the wellbore. In those wellbores, such as horizontal or deviated wellbores or the like, the tractor modules 16 and 18 may be utilized to propel the assembly 10 to the desired location by engaging with the walls of the wellbore. At the desired location, an obstruction, such as a scale deposit or the like is disposed within the wellbore and the assembly 10 is utilized to remove the scale deposit, as outlined further hereinbelow.

The milling module 12 is engaged to rotate the bit 14, and the arms 30 and 32 and the wheels 34 and 36 of the tractor modules 16 and 18 are engaged with the wellbore to move the assembly 10 such that the bit 14 engages with the obstruction or scale deposit. During operation of the milling module, the electronics cartridge 26 controls the speed of the motor 22, and phase current samples from the motor 22 are used to control the torque output of the motor 22. Based on the phase current samples, firmware in the electronics cartridge 26 calculates a torque value experienced on the shaft of the motor 22. The calculated torque value is used to report real-time torque measurements to the surface via the telemetry cartridge 40 or the like. This calculated torque value is also used to request push force adjustment from the electronics cartridge 28 and the tractor modules 16 and 18. The real-time torque measurement is available from the electronics cartridge 26 as it is driving the motor 22 in the rotary module 12, and the torque information is communicated to the cartridge 28 at a fast enough rate to adjust a push force from the tractor modules 16 and 18, as detailed further below.

Figure 3:
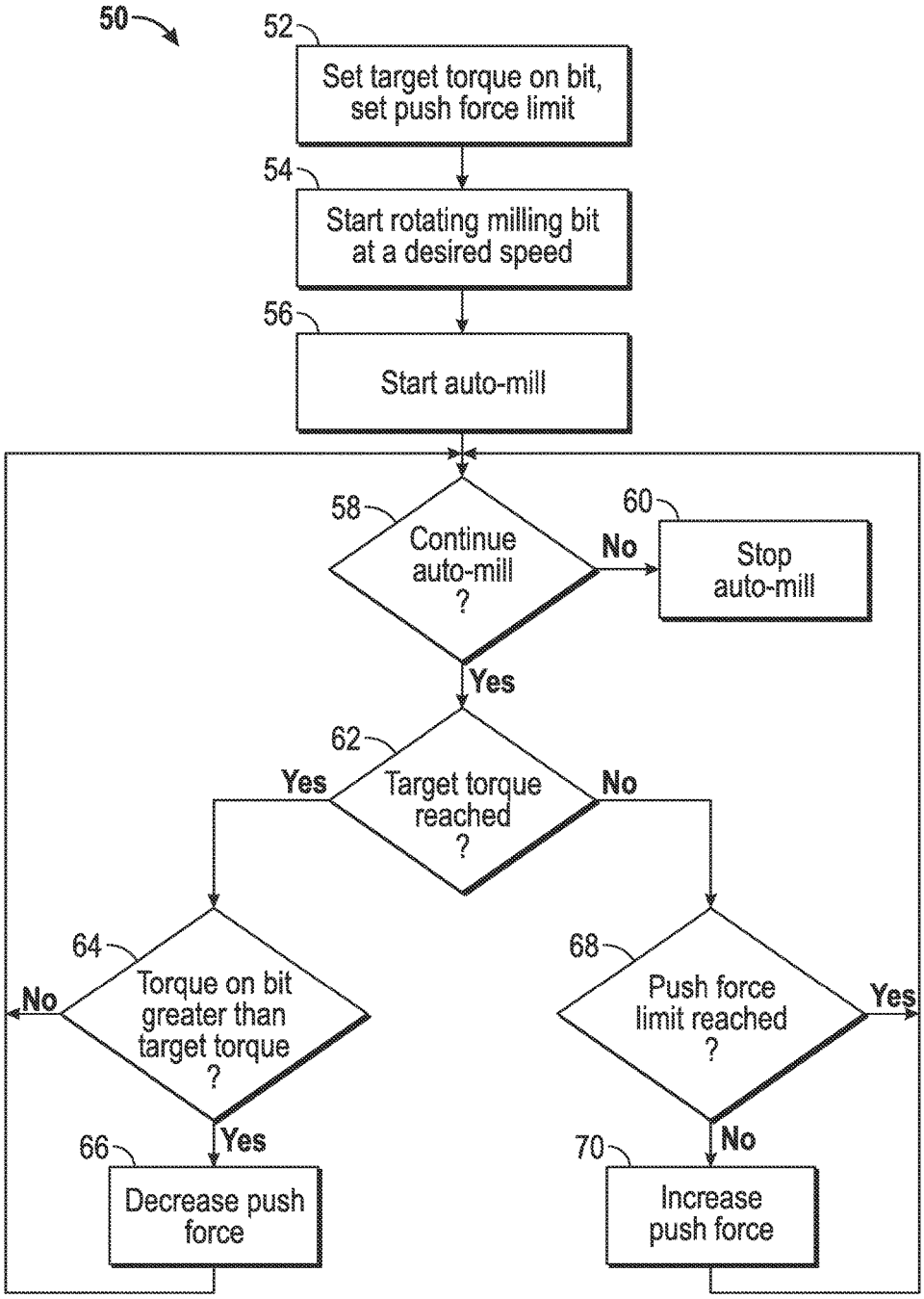
FIG. 3 is a flow diagram of the method for performing an automatic milling procedure according to the disclosure.

There is shown in FIG. 3 a method for performing the automatic milling algorithm, or auto-mill algorithm, indicated generally at 50. At a step 52, a target torque on the bit and push force limit is set by the user, such as at a graphical user interface (not shown) or the like at the surface unit 44. At a step 54, the milling bit 14 is rotated at a desired speed. At a step 56, the auto-mill algorithm is started. At a decision point 58, the auto-mill algorithm is evaluated to continue. If the algorithm is to stop (branch "No"), such as from a command from the user entered at the graphical user interface or the like, the algorithm is stopped at a step 60. If the algorithm is to continue (branch "Yes"), at a decision point 62 the torque (calculated from the milling module 12) is evaluated to determine if the target torque has been reached. If the target torque has been reached (branch "Yes"), then at a decision point 64, the torque is evaluated to determine if it is greater than the target torque. If the calculated torque is not more than the target torque (branch "No"), the method 50 returns to the decision point 58 to evaluate if the auto-mill algorithm is to continue. If the target torque is greater than the target torque (branch "Yes"), the push force (on the tractor modules 16 and 18, and/or on the linear actuator and anchor assembly or the like) is decreased at a step 66, and the method 50 returns to the decision point 58 to evaluate if the auto-mill algorithm is to continue. If at the decision point 62 the target torque has not been reached (branch "No"), then, at a decision point 68, the push force (on the tractor modules 16 and 18) is evaluated to determine if the push force limit has been reached. If the push force limit has been reached (branch "Yes"), then the method 50 returns to the decision point 58 to evaluate if the auto-mill algorithm is to continue. If the push force limit has not been reached (branch "No"), then the push force (on the tractor modules 16 and 18) is increased at a step 70, after which the method 50 returns to the decision point 58 to evaluate if the auto-mill algorithm is to continue.

The electronics module 28 (such as with firmware or the like) adjusts the push force from the tractors 16 and 18 utilizing, for example, proportional-derivative control to regulate push force from the tractors 16 and 18 in response to rapidly varying torque values provided from the electronics module 26 of the rotary module 12.

Figure 4:
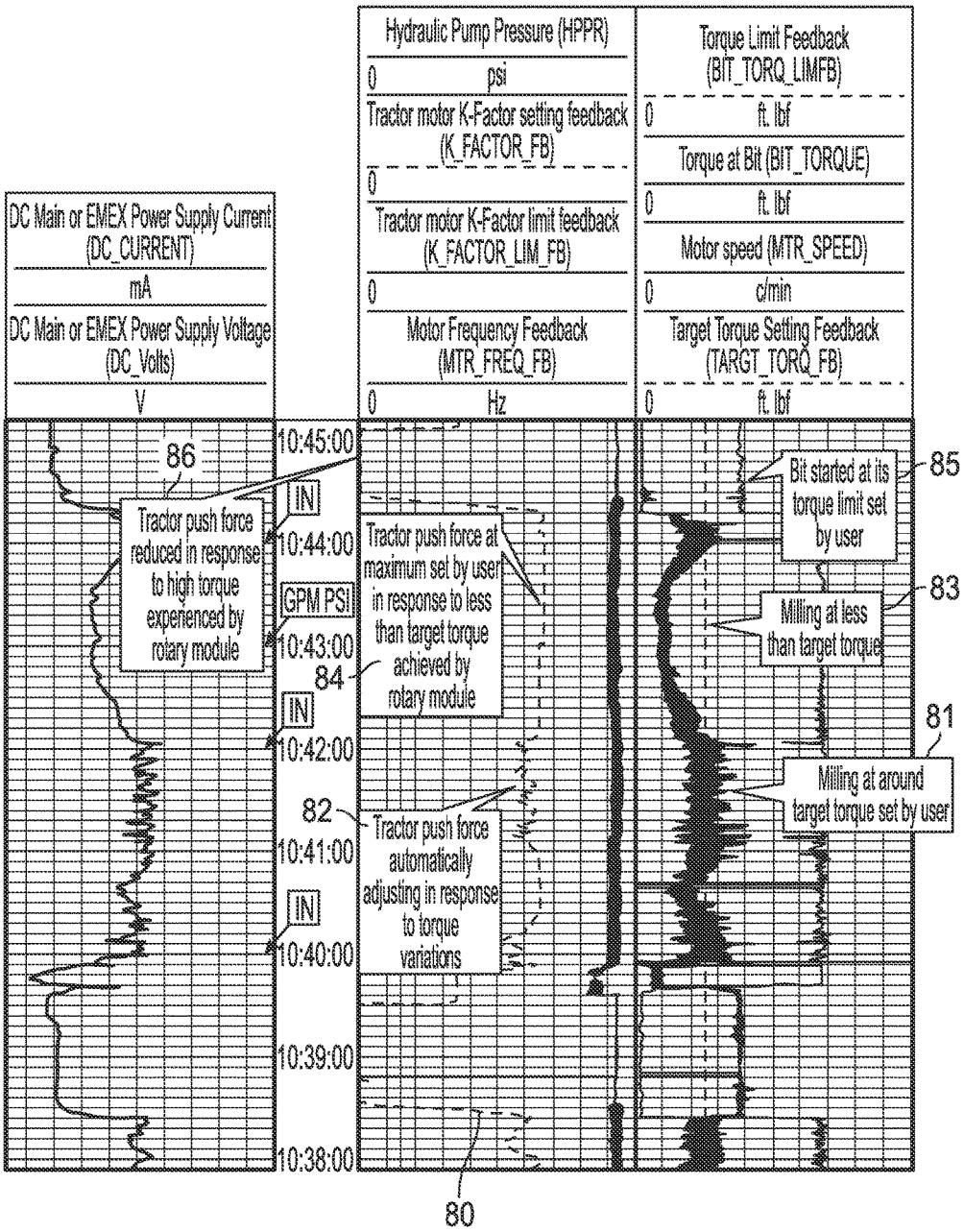
FIG. 4 is a log of a test of the milling assembly and procedure according to the disclosure.

There is shown in FIG. 4 a log archived from testing of the milling operation in a flow-loop test fixture. The log demonstrates the automatic milling algorithm in action when the tool is cutting a rock located inside a test pipe. The line 80 in the middle column shows the tractor modules 16 and 18 automatically adjusting the push force (e.g. point 82) to achieve milling at around the target torque on the bit 14 set by the user (point 81). However, as the tractor push force limit is also set by the user (as noted at step 52 in FIG. 3) the tractor push force is at the limit (maximum set by user shown at point 84) when the torque on the bit is less than its target (point 83). In such a case, the user may choose to increase the push force limit to try to increase the cutting speed of the bit 14 again.

If the bit 14 stalls during an operation (see point 85), the automatic milling algorithm senses the stall condition and may take a few actions to free up the bit 14 again and thereby counteract the stall condition. For example, the automatic milling algorithm may pull the tractor modules 16 and 18 backward (such as by rotating the wheels 34 and 36 in an opposite direction to provide a push force for the assembly 10 in a direction away from the bit 14) to reduce or reverse the push force (see point 86) while the bit 14 is still locked into the scale. If reversing or pulling of the tractor modules 16 and 18 alone does not free up the bit 14, the bit 14 may be rotated in the opposite direction to unlock the bit 14. In some cases, pulling the tractor modules 16 and 18 backward and turning the bit 14 in the opposite direction may be applied simultaneously to unlock the bit. Some of these actions may be automated in firmware as part of the algorithm upon the detection of a stalled bit 14.

The present disclosure describes an algorithm to perform an efficient and intuitive milling operation in a wellbore, such as a cased-hole environment. The automatic milling algorithm achieves controlled material removal operation while minimizing unnecessary human interactions.

The automatic milling algorithm utilizes a wheeled tractor to push the bit of the rotary module against the scale to generate weight on bit. The automatic milling algorithm monitors torque measurement from the rotary module as a feedback to generate an appropriate push force from the tractor tool. The algorithm tries to achieve a target torque on the bit set by the user by automatically adjusting the tractor push force within predetermined limits also set by the user. The algorithm achieves efficient material removal by minimizing stalling of the bit due to high reactive torque and allows the user to take appropriate actions (or make automatic adjustments) in cases of bit stall. The automatic milling algorithm can be implemented as firmware and/or software located in one or more of the first electronics cartridge 26, the second electronics cartridge 28 and the surface unit 44.

The preceding description has been presented with reference to present embodiments. Persons skilled in the art and technology to which this disclosure pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A method (50) for milling an obstruction disposed within a wellbore (W), comprising:

providing a milling assembly (10) for use in the wellbore (W), the milling assembly including a milling module (12) having a motor (22) rotating a milling bit (14), an electronics cartridge (26, 28) for controlling the motor and calculating a torque value based on data received from the motor, at least one push module (16, 18) for engaging with the wellbore and providing a push force against the wellbore to urge the milling assembly in a direction of the milling bit, the electronics cartridge further configured for controlling the at least one push module and calculating a push force value for the at least one push module;

setting a target torque value for the milling module and setting a push force limit value for the at least one push module (52);

disposing the milling assembly into the wellbore;

disposing the milling bit adjacent the obstruction in the wellbore;

operating the milling assembly by rotating the milling bit and engaging the at least one push module with the wellbore (54); and adjusting, iteratively, operation (56, 58) of the milling module and the at least one push module based on the calculated torque value and the calculated push force value to maintain the calculated values at about the target torque value and at or below the push force limit value (66, 70).

2. The method according to claim 1 wherein the milling module motor (22) is an electric motor.

3. The method according to claim 1 wherein the at least one push module comprises at least two push modules (16, 18).

4. The method according to claim 1 wherein the at least one push module comprises at least one tractor module (16, 18) comprising a wheeled tractor assembly having wheels (34, 36) disposed on arms (30, 32) pivotally extending from the at least one tractor module, and including operating the at least one tractor module to engage the wheels with the wellbore (W).

5. The method according to claim 1 including determining a stall condition (64) of the milling bit (14) and adjusting the operation (66) of at least one of the milling module (12) and the at least one push module (16, 18) to counteract the stall.

6. The method according to claim 5 wherein the step of adjusting the operation to counteract the stall includes moving the at least one push module (16, 18) backward to provide a push force (66) in a direction away from the milling bit (14).

7. The method according to claim 5 wherein the step of adjusting the operation to counteract the stall includes reversing a direction of rotation of the milling bit (14).

8. The method according to claim 5 wherein the step of adjusting the operation includes moving the at least one push module (16, 18) backward to provide a push force (66) in a direction away from the milling bit (14) and simultaneously reversing a direction of rotation of the milling bit (14).

9. The method according to claim 1 wherein the step of adjusting the operation includes the following steps:

comparing the calculated torque value with the target torque value (62);

if the target torque value has been reached, determining whether the calculated torque value is greater than the target torque value (64); and if the calculated torque value is greater than the target torque value, decreasing the push force (66).

10. The method according to claim 1 wherein the step of adjusting the operation includes the following steps:

comparing the calculated torque value with the target torque value (62);

if the target torque value has not been reached, determining whether the push force limit value has been reached (68); and if the push force limit value has not been reached, increasing the push force (70).

11. An assembly (10) for milling an obstruction disposed within a wellbore (W), comprising:

a milling module (12) having a motor (22) rotating a milling bit (14) mounted at one end of the assembly (10);

a first electronics cartridge (26) for calculating a torque value based on data received from the motor (22) and operating the motor (22) in response to a comparison of the calculated torque value with a target torque value;

at least one push module (16, 18) for engaging with the wellbore (W) and providing a push force against the wellbore to urge the milling assembly in a direction of the milling bit (14); and a second electronics cartridge (28) for calculating a push force value based on data received from the at least one push module (16, 18) and operating the at least one push module in response to a comparison of the calculated push force with a push force limit value, the first and second electronics cartridges communicating for performing the comparisons iteratively to maintain the calculated torque value and the calculated push force value at about the target torque value and below the push force limit value respectively.

12. The assembly according to claim 11 wherein the motor (22) is an electric motor.

13. The assembly according to claim 11 including a gearbox (24) connected between the motor (22) and the milling bit (14).

14. The assembly according to claim 11 wherein the at least one push module comprises at least two push modules (16, 18).

15. The assembly according to claim 11 wherein the at least one push module (16, 18) comprises a wheeled tractor assembly having wheels (34, 36) disposed on arms (30, 32) pivotally extending therefrom.

16. The assembly according to claim 11 including a compensator module (27) connected between the at least one push module (16, 18) and the first electronics cartridge (26).

17. The assembly according to claim 16 wherein the compensator module (27) is a hydraulic oil reservoir for use with a hydraulic motor to pivot arms (30, 32) of at least one tractor module (16, 18).

18. The assembly according to claim 11 including a logging head (38) mounted at an opposite end of the assembly (10) from the one end at which the milling bit (14) is mounted.

19. The assembly according to claim 18 including a telemetry cartridge (40) connected to the logging head (38).

20. The assembly according to claim 19 including an access line (42) connecting the logging head (38) with a surface unit (44) for communication of power, telemetry and control signals.

* * * * *